US006276021B1

(12) United States Patent
Hohlbein

(10) Patent No.: US 6,276,021 B1
(45) Date of Patent: Aug. 21, 2001

(54) TOOTHBRUSH HAVING A BRISTLE PATTERN PROVIDING ENHANCED CLEANING

(75) Inventor: Douglas J. Hohlbein, Pennington, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/415,385

(22) Filed: Oct. 8, 1999

(51) Int. Cl.[7] ..... A46B 9/04
(52) U.S. Cl. ..... 15/167.1; 15/DIG. 5; D4/104
(58) Field of Search ..... 15/167.1, DIG. 5; D4/104

(56) References Cited

U.S. PATENT DOCUMENTS

D. 380,302 * 7/1997 Volpenhein ..... D4/104
D. 402,116 * 12/1998 Magloff et al. ..... D4/104
D. 403,510 * 1/1999 Menke et al. ..... D4/104
D. 422,143 * 4/2000 Beals et al. ..... D4/104
D. 424,808 * 5/2000 Beals et al. ..... D4/104
D. 425,306 * 5/2000 Beals et al. ..... D4/104
5,335,389 * 8/1994 Curtis et al. ..... 15/167.1
5,341,537 * 8/1994 Curtis et al. ..... 15/167.1
5,628,082 * 5/1997 Moskovich ..... 15/167.1 X
5,799,353 * 9/1998 Oishi et al. ..... 15/167.1
5,802,656 * 9/1998 Dawson et al. ..... 15/167.1 X
5,991,959 * 11/1999 Raven et al. ..... 15/167.1 X

* cited by examiner

*Primary Examiner*—Mark Spisich
(74) *Attorney, Agent, or Firm*—Henry S. Goldfine

(57) ABSTRACT

A toothbrush having a plurality of peripheral bristle tufts and a plurality of adjacent bristle bars located internally within the head thereto, which bristle bars provide support for the peripheral bristle tufts during brushing, such that the stiffness and associated cleaning ability of the peripheral bristle tufts is enhanced.

18 Claims, 2 Drawing Sheets

TOOTHBRUSH HAVING A BRISTLE PATTERN PROVIDING ENHANCED CLEANING

FIELD OF THE INVENTION

The present invention relates to toothbrushes, and more particularly, to toothbrushes containing a combination of a bristle bar located internally in the toothbrush head and bristle tufts located external thereto, about the periphery of the toothbrush head; wherein the bristle bar provides support to the bristle tufts as they are deflected thereto during brushing, enhancing tooth and gumline cleaning.

BACKGROUND OF THE INVENTION

The primary purpose of toothbrushes is to remove plaque and debris from tooth surfaces, both along their outer surfaces and in the interproximal areas between the teeth. As disclosed in U.S. Pat. No. 5,511,275, to Volpenhein, the bristle tufts of a toothbrush must be sufficiently stiff to generate enough force to remove plaque and debris, especially in the interproximal areas. Stiffness, as defined by Volpenhein, not only relates to the stiffness characteristics of bristles, but also to how the bristles are arranged in tufts, i.e. a buttressing effect.

U.S. Pat. No. 5,628,082, to Moskovich discloses a combination of conventional bristle tufts, i.e. substantially cylindrical in form and bristle bars, i.e. enlarged tufts of bristles arranged in elongated geometric forms with substantially rectangular cross-sections. The particular bristle bars disclosed in Moskovich have rectangular or U-shaped footprints and are combined with the bristle tufts in a generally transverse alignment to the longitudinal axis of the brush head. In the most preferred embodiment, the bristle bars are shorter than the bristle tufts, allowing the bristle tufts to engage the interproximal spaces between the teeth and the bristle bars to squeegee the debris from the teeth surface. Further, Moskovich discloses "gumline" tufts located about the periphery of the toothbrush head which are angled outward. Moskovich does not disclose the use of such gumline bristle tufts in combination with bristle bars oriented substantially parallel to the longitudinal axis of the toothbrush.

There is a continuing need in the art for new combinations and arrangements of bristle tufts to provide improved stiffness to enhanced plaque and debris removal, especially within interproximal spaces.

SUMMARY OF THE INVENTION

In accordance with the present invention, a toothbrush is provided which includes an elongated member having a handle at one end and a head at the other end. The head is provided with a plurality of bristle tufts located about the periphery of the head ("peripheral bristle tufts") and bristle bars located adjacent to the peripheral bristle tufts which provide support to the peripheral bristle tufts, as these peripheral bristle tufts are deflected toward the bristle bars during brushing. Such support enhances the stiffness of the peripheral bristle tufts, resulting in an enhancement of their overall cleaning ability, especially their ability to penetrate and clean interproximal areas.

In a further embodiment of the present invention, incremental bristle bars or bristle tufts can be located centrally within the toothbrush head, internal to the bristle bar tufts adjacent to the peripheral bristle tufts. Such additional, centrally located bristle bars or tufts provide incremental bristle area and also enhance the stiffness of these now intermediate bristle bars adjacent to the peripheral bristle tufts, both effects adding to the overall cleaning ability of the toothbrush.

BRIEF DESCRIPTION OF THE DRAWINGS

While the specification concludes with claims which particularly point out and distinctly claim the invention, it is believed that the present invention will be better understood from the following description of several particularly preferred embodiments taken in conjunction with the accompanying drawings, in which like reference numerals identify similar elements:

DETAILED DESCRIPTION OF PARTICULARLY PREFERRED EMBODIMENTS

Figure 1:
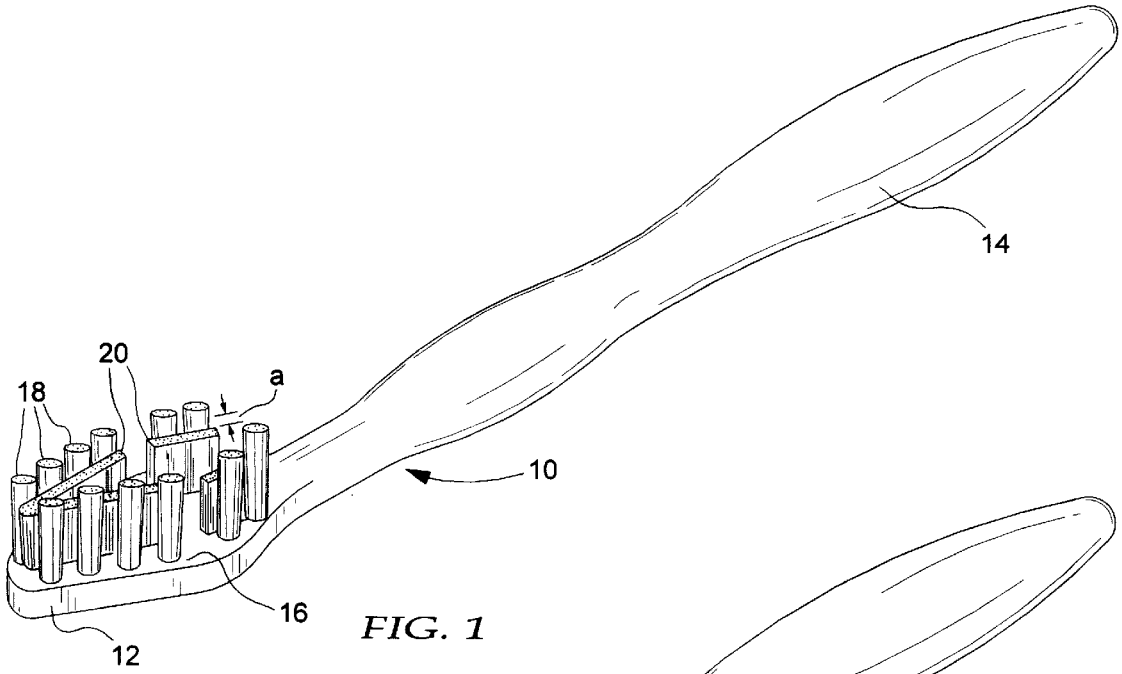
FIG. 1 is a perspective view of a first embodiment of a toothbrush of the present invention; wherein the bristle bars are generally in the form of parallelepipeds.

Referring now to FIG. 1 of the drawings, the toothbrush 10 of this invention includes a body formed of an elongated member with a head 12 on one end and a handle 14 on the other. The handle 14 may be conventional in shape and forms no part of this invention. The head 12 has an flattened bristle mounting surface or face 16, from which extend a plurality of bristles having proximal ends attached to the face 16 and distal ends extending outwardly from the head 12. As seen in FIG. 1, there are two types of bristle groups, the first type being peripheral bristle tufts 18, located about the periphery of the head 12. These peripheral bristle tufts 18 are generally symmetrical in cross-section, i.e. circular; square; or, if oval or rectangular, having a larger cross-sectional dimension less than about 1.3 times the shorter cross-sectional dimension. Further, these peripheral bristle tufts 18 have a cross-sectional diameter or larger dimension of from about 1.0 mm to about 2.0 mm, preferably from 1.4 mm to about 1.9 mm, and more preferably from about 1.5 mm to about 1.7 mm. The second type of bristle group shown are bristle bars 20, which are generally elongated in shape and which are located adjacent to the peripheral bristle tufts 18 and internal to the head 12 of the peripheral bristle tufts 18. Bristle bars 20 have a cross-sectional length of at least 2.5 mm, preferably at least 3.0 mm and more preferably at least 4 mm.

Figure 2:
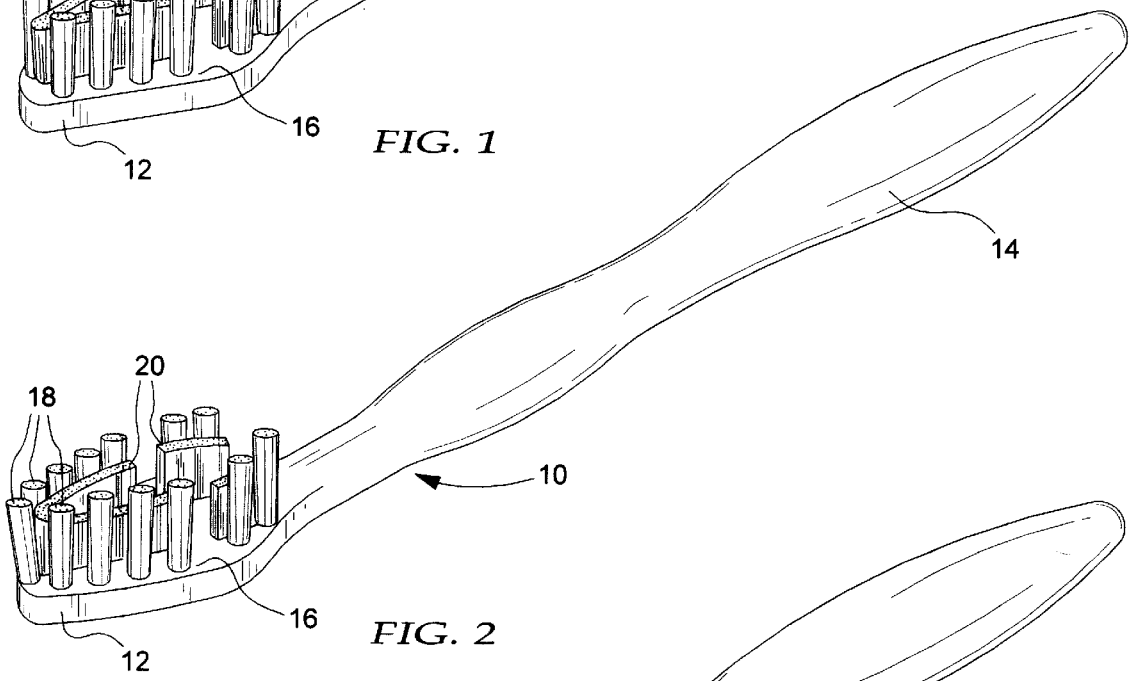
FIG. 2 is a perspective view of a second embodiment of a toothbrush of the present invention; wherein the bristle bars have generally curved foot-prints.

As illustrated in FIGS. 1 and 2 the bristle bars 20 of the present invention can be shaped as geometric forms which may be substantially parallelepipeds; or alternately have curved foot-prints to conform to the curvature of the toothbrush head 12; or combinations thereof. The peripheral bristle tufts 18 can preferably be taller, i.e. in height from the face 16, than the bristle bars 20 or any other bristle tufts on the toothbrush. Peripheral bristle tufts 18 having such extra height over any other bristle tufts within the head 12 will penetrate into the interproximal areas between teeth for enhanced cleaning therein without interference by such other shorter bristle tufts. It is preferred that the peripheral bristle tufts are from 9.0 mm to about 13.0 mm in height about the face 16 of the toothbrush, preferably from about 11 mm to 12 mm in height. Further, the bristle bars 20 should be at least about 50% to 85% of the height of the peripheral bristle tufts 18, so as to provide the desired support to the peripheral bristle tufts 18.

As mentioned above, U.S. Pat. No. 5,511,275 to Volpenhein discloses that in addition to the stiffness characteristics of the bristles, the more tightly bristles are packed together in tufts, the more additional support they will lend each other to enhance their overall stiffness and cleaning ability. Volpenhein further discloses as a measure of this effect a Buttress Factor defined as the cross-sectional area taken up by the bristles divided by the total cross sectional area of the tuft at its base, i.e. from 0 to 1. The higher the Buttress Factor, the greater the stiffness and cleaning ability of the bristles. While Volpenhein discloses toothbrushes having Buttress Factors of from 0.8 to 0.96, the bristle tufts 18 and bristle bars 20 in the present invention surprisingly only require a Buttress Factor of from about 0.6 to about 0.75. Preferably the Buttress Factor of both the bristle tufts 18 and the bristle bars 20 of the present invention is from about 0.65 to about 0.7, and most preferably about 0.68. This Buttress Factor range is further advantageous in equating closely with Du Pont Polymers' recommended optimum bristle wear performance packing factor range of 0.63 to 0.74, defined similarly as filament cross-sectional area divided by tuft hole opening. See, Du Pont Polymers, Wilmington, Del. 19898 publication Z-1737.

Figure 3:
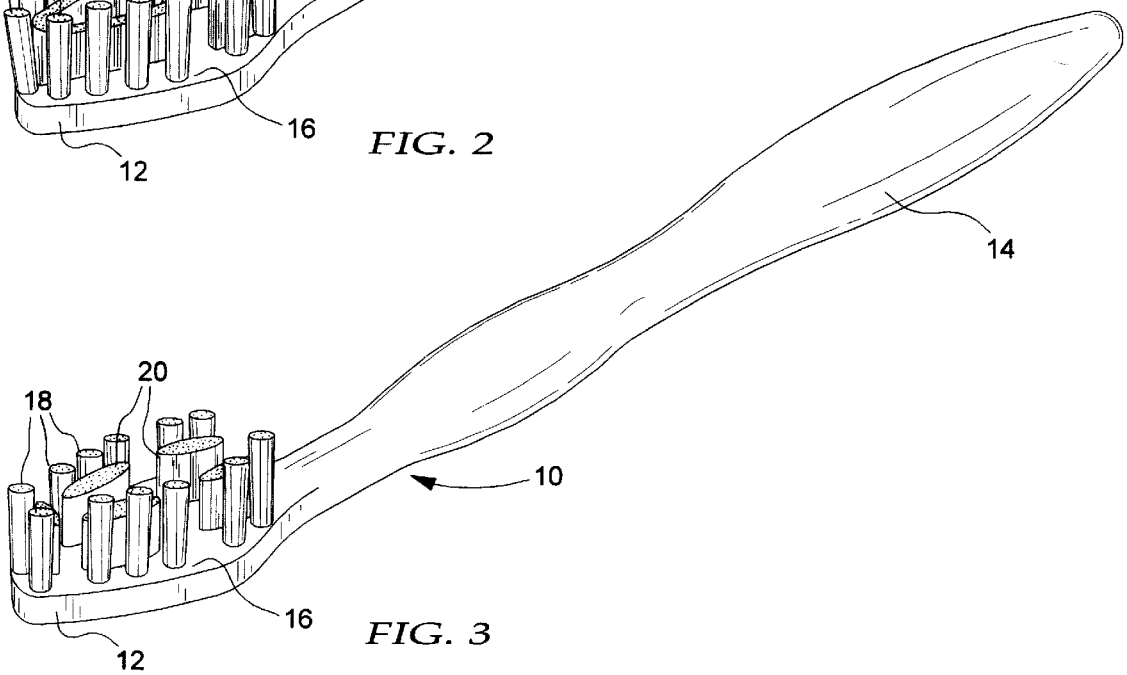
FIG. 3 is a perspective view of a third embodiment of a toothbrush of the present invention; wherein the bristle bars have generally oval footprints.

As shown in FIGS. 1, 2 and 3 the bristle bars 20 may be generally have rectangular, curved, or oval foot-prints. The general shape of the bristle bars 20 is not critical, so long as the bristle bars are of sufficient dimension to provide the adjacent peripheral tufts support during tooth brushing. Considering the simultaneous brushing movement of toothbrushes from the front to the rear of the mouth and up and down; the bristle bars 20 should be of such a length and such a spacing from the peripheral bristle tufts 18, to provide support to each adjacent peripheral bristle tuft 18 when the adjacent peripheral bristle tuft is deflected toward the particular bristle bar 20 at any angle up to 20 degrees from the perpendicular therebetween, preferably up to 30 degrees, more preferably up to 40 degrees and most preferably up to 50 degrees or more.

The width of the bristle bars 20, shown as dimension "a" in FIG. 1, should be at least about 1.0 mm, preferably at least about 1.5 mm. Further, the narrowest transverse space between each peripheral tuft 18 and the supporting bristle bar 20 therefore, must not be greater than about 1.5 mm, and preferably not greater than 1.0 mm and most preferably not greater than about 0.7 mm.

Referring again to FIGS. 1 and 2, it can be seen that in each figure a transverse opening is provided between the bristle tufts 18 and extending through the bristle bars 20, toward the center of the head 12; this opening being located middle way up the head 12. This opening may be provided to enhance the users ability to clean the toothbrush of toothpaste and debris accumulated during brushing, by providing a clear channel for rinse water to the interior of the head 12. Alternatively, additional openings can be provided as is illustrated in FIG. 3, to further enhance the ease of cleaning.

Figure 4:
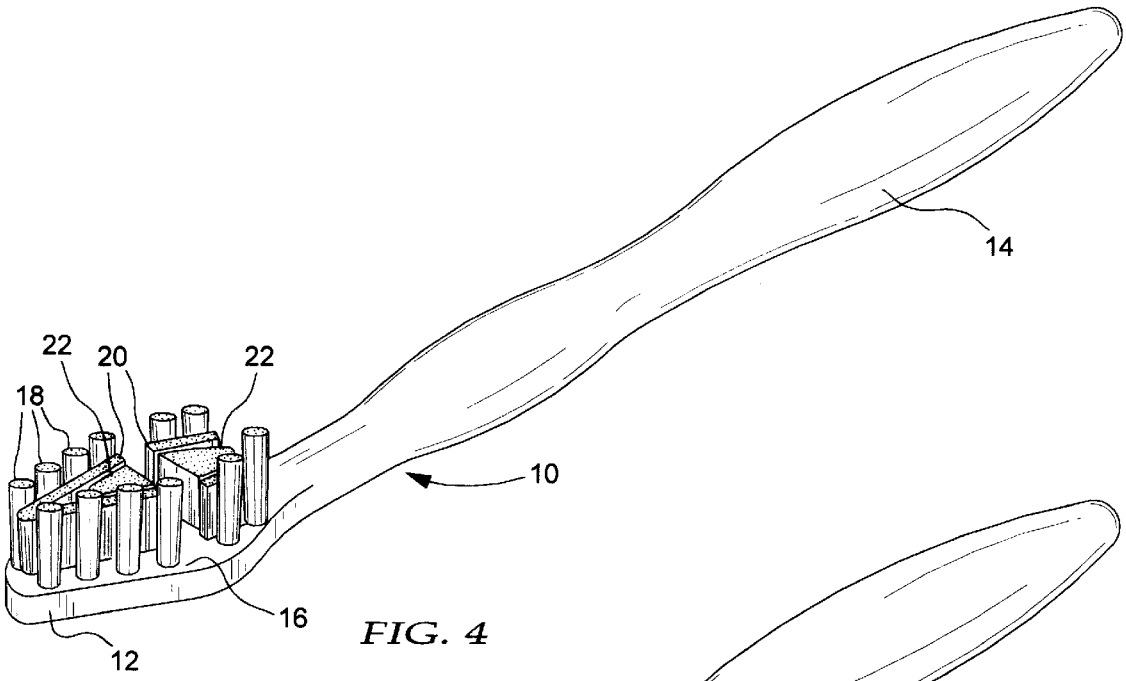
FIG. 4 is a perspective view of a fourth and alternative embodiment of the toothbrush shown in FIG. 1, wherein there are additional bristle bars located central to the toothbrush head.
Figure 5:
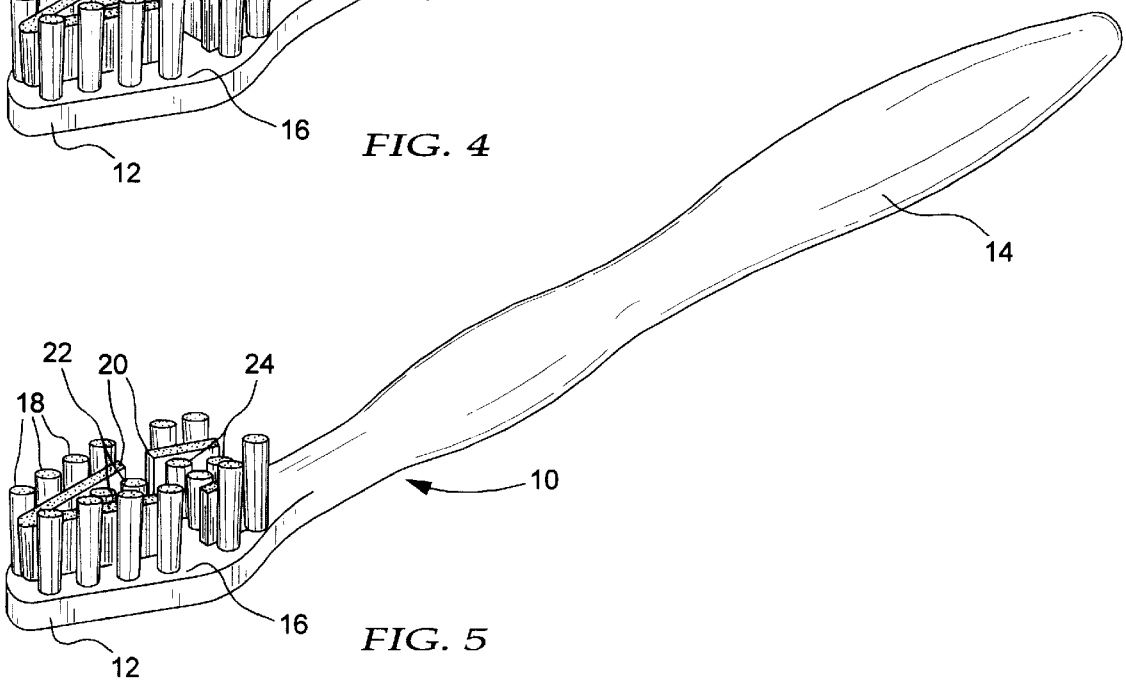
FIG. 5 is a perspective view of a fifth and alternative embodiment of the toothbrush shown in FIG. 1, wherein there a additional bristle tufts located central to the toothbrush head.

A second embodiment of the present invention, as illustrated in FIG. 4, contains a head 12 having extending from its face 16 the same peripheral tufts 18 and adjacent bristle bars 20 internal thereto as the afore-described embodiment; however, in addition to these sets of bristle tufts 18 and bars 20, there is a set of additional bristle bars 22 located central to the head ("central bristle bars"). These central bristle bars, illustrated as wedges in FIG. 4, provide not only additional bristle area for cleaning, but also, enhanced support for the now intermediate within the head located bristle bars 20, to enhance the overall stiffness and cleaning ability of the toothbrush 10. These central bristle bars 22 may have cross-sections other than wedges, such as ovals, egg shapes, or rectangular.

A third, alternative embodiment of the present invention is similar to the second embodiment disclosed above, except the central bristle bars 22 can be replaced by a plurality of central bristle tufts 24, similar to the individual, peripheral bristle tufts 18. The height of any such central bristle tufts 24 above the brush face 16 can be equal to or less than that of the now intermediate within the head located bristle bars 20.

Toothbrush bristles useful in the present invention are typically monofilaments of nylon, such as nylon 612, or of polyester, having a circular cross section. A preferred nylon 612 is available from the Du Pont Polymers Division, Wilmington, Del. 19898, under the trademark Tynex 612. The distal ends of such monofilament bristles, extending from the face 16 of the toothbrush preferred have rounded ends to lower any risk of damage to the soft and hard oral tissue compared to bristles without rounded tips.

The toothbrush body can be molded of a variety of flexibly resilient materials, such as polyamide, i.e. nylon; polyester or a co-polyester; acrylonitrile butadiene styrene (ABS); polycyclohexylene dimethylene terephthalate that is acid modified (PCTA); or polypropylene; preferably polypropylene or if a "transparent" appearance is desired of polyester. A suitable polypropylene, with a flexural modulus of 216,000 psi by ASTM test method D790, is available from Huntsman Corporation, Longview, Tex., 75603 under the trade-designation Huntsman Polypropylene P4G3Z-039. Another suitable polypropylene is available from Amoco Polymers, Inc., Alpharetta, Ga. 30202-3914, sold under the trade designation 7635 with a flexural modulus of about 275,000 psi. A toothbrush handle of such a 216,000 to 275,000 psi material will provide enhanced rigidity to allow the user to better control and manipulate the position of the toothbrush head during brushing.

Clear polyesters useful to provide such a "transparent" appearance of the toothbrush body, include polyethylene terephthalate or a copolyester, such as poly-cyclohexylene dimethylene terephthalate, acid modified, polyester (PCTA) or styrene acrylonitrile (SAN), acrylonitrile butadiene styrene (ABS), polymethyl methacrylate (PMMA) or a cellulosic plastic, such as cellulose acetate propionate (CAP).

The toothbrush body can be molded by conventional injection molding technology, which technology is well known in the art. For example, in accordance with the present invention, the body can be injection molded in a single step.

The toothbrush bristles may be implanted in the toothbrush head 12, either before or after joining the heads to the handles using modem non-staple technology as disclosed in U.S. Pat. Nos. 4,635,313, 4,637,660, 4,954,305, 5,045,267, 5,609,890, 5,390,984, 5,533,791, and 5,823,633. Such non-staple technology involves processes wherein the bristle tufts 18 or bristle bars 20 are fused into the toothbrush head 12, by heating both the bristle tufts 18 or bristle bars 20 and the toothbrush head 12, which are then brought together in a fusion process. Alternatively, the ends of the bristle tufts 18 or bristle bars 20 can be pre-positioned in the injection mold prior to the introduction of the toothbrush material, which toothbrush material is subsequently injected about the ends of the bristle tufts 18 or bristle bars 20 locking them in place in the toothbrush head 12, in another non-staple process.

What is claimed is:

1. A toothbrush comprising:

an elongated member having a head at one end and a handle at the other end, generally aligned along a central longitudinal axis;

said head having a face with a peripheral portion about its exterior and an internal portion adjacent thereto;

said peripheral portion having a plurality of peripheral bristle tufts extending therefrom, which bristle tufts are generally symmetrical in cross-section, with a cross-sectional diameter or larger diameter of from about 1.0 mm to about 2.0 mm;

said internal portion having a plurality of bristle bars extending therefrom, which bristle bars are generally elongated in shape with a elongated length of at least 3.0 mm and which bristle bars are generally disposed about and generally aligned with the longitudinal axis of the toothbrush; wherein, during brushing, the bristle bars provide support to the peripheral bristle tufts, as the peripheral bristle tufts are deflected toward and come in contact with the elongated length of the bristle bars.

2.A toothbrush according to claim 1 wherein, the peripheral bristle tufts and bristle bars have a Buttress Factor of from about 0.6 to about 0.75.

3. A toothbrush according to claim 1 wherein, the peripheral bristle tufts extend from about 9 mm to 13 mm in height above the face.

4. A toothbrush according to claim 3 wherein, the bristle bars extend at least 50% of the height above the face of the peripheral bristle tufts.

5. A toothbrush according to claim 1 wherein, the width of the bristle bars is at least about 1.0 mm.

6. A toothbrush according to claim 1 wherein, the length of the intermediate bristle bars and spacing between the bristle bars and adjacent peripheral tufts is such that the bristle bars will provide support to the peripheral bristle tufts when the peripheral bristle tufts are deflected toward the bristle bars at any angle up to 20 degrees from the perpendicular with respect to the toothbrush face.

7. A toothbrush comprising:

an elongated member having a head at one end and a handle at the other end, generally aligned along a central longitudinal axis;

the head having a face with a peripheral portion about the exterior thereof, an intermediate portion adjacent thereto, and a central portion adjacent to said intermediate portion and centrally located in said face;

said peripheral portion having a plurality of peripheral bristle tufts extending therefrom, which bristle tufts are generally symmetrical in cross-section, with a cross-sectional diameter or larger diameter of from about 1.0 mm to about 2.0 mm;

said intermediate portion having a plurality of intermediate bristle bars extending therefrom;

said central portion having at least one central bristle bar extending therefrom;

said bristle bars are generally elongated in shape with a elongated length of at least 3.0 mm and which bristle bars are generally disposed about and generally aligned with the longitudinal axis of the toothbrush;

the plurality of intermediate bristle bars are located adjacent to the bristle tufts and internal in the face therefrom;

and wherein during brushing, the at least one central bristle bar provide support to the intermediate bristle bars and the intermediate bristle bars provide support to the peripheral bristle tufts, as the intermediate bristle bars are deflected toward and contact the elongated length of the at least one central bristle bar and the peripheral bristle tufts are deflected toward and come in contact with the elongated length of the intermediate bristle bars.

8. A toothbrush according to claim 7 wherein, the peripheral bristle tufts, intermediate bristle bars and at least one central bristle bar have a Buttress Factor of from about 0.6 to about 0.75.

9. A toothbrush according to claim 7 wherein, the peripheral bristle tufts extend from about 9 mm to 13 mm in height above the face.

10. A toothbrush according to claim 9 wherein, the bristle bars extend at least 50% of the height above the face of the peripheral bristle tufts.

11. A toothbrush according to claim 7 wherein, the width of the intermediate bristle bars is at least about 1.0 mm.

12. A toothbrush according to claim 7 wherein, the length of the intermediate bristle bars and spacing between the intermediate bristle bars and adjacent peripheral tufts is such that the intermediate bristle bars will provide support to the peripheral bristle tufts when the peripheral bristle tufts are deflected toward the intermediate bristle bars at any angle up to 20 degrees from the perpendicular with respect to the toothbrush face.

13. A toothbrush comprising:

an elongated member having a head at one end and a handle at the other end, generally aligned along a central longitudinal axis;

the head having a face with a peripheral portion about the exterior thereof, an intermediate portion adjacent thereto, and a central portion adjacent to said intermediate portion and centrally located in said face;

said peripheral portion having a plurality of peripheral bristle tufts extending therefrom, which bristle tufts are generally symmetrical in cross-section, with a cross-sectional diameter or larger diameter of from about 1.0 mm to about 2.0 mm;

said intermediate portion having a plurality of intermediate bristle bars extending therefrom, which bristle bars are generally elongated in shape with a elongated length of at least 3.0 mm and which bristle bars are generally disposed about and generally aligned with the longitudinal axis of the toothbrush;

said central portion having a plurality of central bristle tufts extending therefrom, which bristle tufts are generally symmetrical in cross-section, with a cross-sectional diameter or larger diameter of from about 1.0 mm to about 2.0 mm;

wherein during brushing, the central bristle tufts provide support to the intermediate bristle bars and the intermediate bristle bars provide support to the peripheral bristle tufts, as the intermediate bristle bars are deflected toward and contact the central bristle tufts and the peripheral bristle tufts are deflected toward and come in contact with the elongated length of the intermediate bristle bars.

14. A toothbrush according to claim 13 wherein, the peripheral bristle tufts, intermediate bristle bars and central bristle tufts have a Buttress Factor of from about 0.6 to about 0.75.

15. A toothbrush according to claim 13 wherein, the peripheral bristle tufts extend from about 9 mm to 13 mm in height above the face.

16. A toothbrush according to claim 15 wherein, the intermediate bristle bars extend at least 50% of the height above the face of the peripheral bristle tufts.

17. A toothbrush according to claim 13 wherein, the width of the intermediate bristle bars is at least about 1.0 mm.

18. A toothbrush according to claim 13 wherein, the length of the intermediate bristle bars and spacing between the intermediate bristle bars and adjacent peripheral tufts is such that the intermediate bristle bars will provide support to the peripheral bristle tufts when the peripheral bristle tufts are deflected toward the intermediate bristle bars at any angle up to 20 degrees from the perpendicular with respect to the toothbrush face.

* * * * *